US011306448B2

(12) United States Patent
Jansen

(10) Patent No.: US 11,306,448 B2
(45) Date of Patent: Apr. 19, 2022

(54) PAVING ASSEMBLY AND METHOD OF PROVIDING SUCH AN ASSEMBLY

(71) Applicant: JANSEN INFRA VERHUUR B.V., Dongen (NL)

(72) Inventor: Johannes Hendrikus Cornelis Jansen, Dongen (NL)

(73) Assignee: JANSEN INFRA VERHUUR B.V., Dongen (NL)

( * ) Notice: Subject to any disclaimer, the term of this patent is extended or adjusted under 35 U.S.C. 154(b) by 0 days.

(21) Appl. No.: 17/436,193

(22) PCT Filed: Mar. 5, 2020

(86) PCT No.: PCT/NL2020/050141

§ 371 (c)(1),
(2) Date: Sep. 3, 2021

(87) PCT Pub. No.: WO2020/180181

PCT Pub. Date: Sep. 10, 2020

(65) Prior Publication Data

US 2022/0042254 A1 Feb. 10, 2022

(30) Foreign Application Priority Data

Mar. 7, 2019 (NL) ..... 2022692

(51) Int. Cl.
*E01C 19/48* (2006.01)

(52) U.S. Cl.
CPC ..... *E01C 19/48* (2013.01); *E01C 2301/02* (2013.01)

(58) Field of Classification Search
CPC ..... E01C 19/48; E01C 2301/02
(Continued)

(56) References Cited

U.S. PATENT DOCUMENTS 5,735,634 A * 4/1998 Ulrich ..... E01C 19/48 404/102
6,193,438 B1 * 2/2001 Heims ..... E01C 19/48 404/101

(Continued)

FOREIGN PATENT DOCUMENTS

DE 29715467 U1 10/1997
DE 29712038 U1 1/1998

(Continued)

OTHER PUBLICATIONS

International Search Report and Written Opinion for the International Patent Application No. PCT/NL2020/050141, dated May 4, 2020, 21 pages.

(Continued)

*Primary Examiner* — Raymond W Addie
(74) *Attorney, Agent, or Firm* — Kacvinsky Daisak Bluni PLLC

(57) ABSTRACT

A paving assembly includes a transporter with a material feed to arrange a layer of paving material at a first distance from the transporter, a first material hopper in connection with the material feed to receive a paving material, and a superstructure selectively arrangeable on or over the transporter. The superstructure includes a frame, a further material feed extending beyond the transporter to convey the paving material at a second distance from said transporter, and a second material hopper. The superstructure includes the first and the second material hopper each arranged substantially central relative to the width of the transporter and accessible during use to allow them to be filled with paving material by a feeder for a continuous paving operation. The further material feed is arranged substantially central relative to the width of the transporter and extending
(Continued)

over the transporter. A method of providing such a paving assembly.

13 Claims, 3 Drawing Sheets

(58) Field of Classification Search
USPC ..... 404/72, 75, 101–110, 118
See application file for complete search history.

(56) References Cited

U.S. PATENT DOCUMENTS 6,467,992 B1 * 10/2002 Dietrich ..... E01C 19/48 404/101
7,134,806 B2 * 11/2006 Lazic ..... E01C 19/46 404/111
7,572,081 B2 * 8/2009 Buschmann ..... E01C 19/17 404/101
9,567,715 B2 * 2/2017 Pedersen ..... E01C 19/42
10,001,783 B2 * 6/2018 Zahr ..... E01C 19/48
2010/0296867 A1 * 11/2010 Buschmann ..... E01C 19/48 404/108
2013/0318102 A1 * 11/2013 Fontignie ..... H04L 67/2842 707/748
2016/0170415 A1 * 6/2016 Zahr ..... E01C 19/004 701/23
2018/0297788 A1 * 10/2018 Grathwol ..... E01C 23/065

FOREIGN PATENT DOCUMENTS

DE 202005004049 U1 7/2005
JP 2010031533 A 2/2010

OTHER PUBLICATIONS

International Preliminary Report on Patentability for the International Patent Application No. PCT/NL2020/050141, dated Apr. 28, 2021, 6 pages.
Written Opinion of the International Preliminary Examining Authority for the International Patent Application No. PCT/NL2020/050141, dated Jan. 26, 2021, 6 pages.

* cited by examiner

PAVING ASSEMBLY AND METHOD OF PROVIDING SUCH AN ASSEMBLY

This is a national stage application filed under 35 U.S.C. § 371 of pending international application PCT/NL2020/050141, filed Mar. 5, 2020, which claims priority to Netherlands Patent Application No. NL 2022692, filed Mar. 7, 2019, the entirety of which applications are hereby incorporated by reference herein.

The present invention relates to a paving assembly, and more in particular to a paving assembly comprising a transporter with a material feed configured to arrange a layer of paving material at a first distance from said transporter.

The invention is further related to a superstructure of a paving assembly, and to a method of providing such a paving assembly.

Dependent on the type of road surface required, it is sometimes sufficient if a paving machine arranges only one layer of paving material, while under different circumstances it would be preferable if two layers of paving material could be arranged in a single operation.

It is common practice to apply two paving machines if two layers of paving material are to be arranged on a road surface. These two paving machines are driven forward simultaneously and independently from each other, while they are also independently supplied with paving material. A first paving machine is used to arrange a first layer of paving material, and a second paving machine drives over this first layer of paving material to arrange a second layer of paving material on top of the first layer of paving material. In this way two layers of paving material are arranged in a single operation using two paving machines.

Most paving companies only have a limited amount of paving machines at their disposal, and therefore have to rely on manually converting the most forward paving machine from a single layer operation to a twin layer operation and vice versa. Such a conversion is laborious and time consuming, and requires in the order of two days work. During this conversion, the paving machine is out of use.

Clients nowadays require contractors to provide pavement having a high level of consistency, even putting fines on each time a paving assembly has to stop during forward movement when applying said pavement. This may seem highly exaggerated at first sight, but each time a paving assembly stops, the layers of pavement will cool down too much before they may be compacted. This causes a noticeable difference in feel when driving of the pavement, and more importantly, in a significant decrease in lifetime of the pavement. Therefore contractors are often required to provide proof that a predetermined distance of pavement has been applied in one go, i.e. with unnecessary stops. The high level of consistency, next to the above mentioned stops, may also be related to an even compacting of the pavement.

DE 20 2005 004 049 U1 is considered the closest prior art, and at least the characterizing features of the independent claims are novel relative to this document. In the wording of the present invention DE 20 2005 004 049 U1 discloses: a transporter with a material feed configured to arrange a layer of paving material at a first distance from said transporter; a first material hopper in connection with the material feed and configured to receive a paving material; and a superstructure that is selectively arrangeable on or over the transporter, wherein said superstructure comprises: a frame; a further material feed extending beyond the transporter and configured to convey the paving material at a discharge at a second distance from said transporter; and a second material hopper in connection with the further material feed and configured to receive the paving material. The further material feed is arranged sideways of the transporter.

A major disadvantage of the paving assembly disclosed in DE 20 2005 004 049 U1 is the uneven weight distribution thereof, causing the pavement to be compacted in an uneven manner. A first paving machine is configured to apply a first layer, i.e. the base layer in a two-layer arrangement. A second paving machine is configured to apply a second layer, i.e. a top layer in a two-layer arrangement. In order to supply the second paving machine that is configured to apply the second layer with paving material, this second paving machine has to drive offset relative to the first paving machine that applies the first layer. In order to arrange the second layer along substantially above the whole width of the first layer there below, the screeds of the first paving machine and the second paving machine are extended at different distances sideways relative to the transporter of the respective paving machine. By setting the distances that the screeds extend opposite for the second paving machine relative to the first paving machine, the offset between the first and the second paving machine may be compensated for. This however comes at a price, because the difference in sideward extending screed lengths causes an uneven weight distribution of each one of the first and the second paving machine, causing the pavement to be compacted in an uneven manner. A further disadvantage of the paving assembly disclosed in DE 20 2005 004 049 is that they will need to stop every time a new truck brings a new supply of paving material.

DE 297 12 038 U1 discloses a paving assembly comprises two material hoppers. A first material hopper is in connection with a material feed of the transporter, whereas a second material hopper is arranged on a pivotable arm. In order to fill the first material hopper with a truck, the second material hopper is pivoted upward to provide access to the first material hopper. At each time, only one of the first material hopper and the second material hopper is readily accessible to be filled with paving material by a truck, causing many filling stops during use. After all, the first material hopper and the second material hopper need to be filled at separate times. Moreover, the supplies of paving material need to be set at predetermined doses in correspondence to the desired ratio of the first layer and the second layer of pavement in order to have both the first and the second material hopper empty at the same time to reduce the number of filling stops at least to a minimum.

DE 297 15 467 U1 discloses a paving assembly of a transporter and a superstructure that comprises only one material hopper. Instead of a second material hopper, said paving assembly of transporter and superstructure comprises a conveyor. This conveyor is configured to transport paving material to a further paving machine, where it is received in a hopper. During use, the paving assembly may apply a first layer, e.g. a base layer, of pavement, while the further paving machine may apply a second layer, e.g. a top layer, on top of the first layer. The combination of paving assembly and further paving machine proposed in this document allows the first layer and the second layer to be arranged substantially continuously, but has the disadvantage that the material hopper of the paving assembly and the material hopper of the further paving machine are both used as material buffers. After all, paving material may be applied by the feeder to only one of the material hopper of the paving assembly and the conveyor at a specific time. Thus, even though a feeder may be used, the supply of material to the paving assembly and to the further paving machine is still intermittent. Although this does not prevent continuous application, it does result in the material hoppers to be used as material buffers having a varying supply. This is especially relevant for the material hopper of the further paving machine, because the second layer, i.e. the top layer, is normally applied at a smaller thickness that the first layer. A varying weight of the further paving machine causes an inconsistency of the compactness of the paving material, and especially of the second layer.

JP 2010 031533 A is acknowledged as further prior art.

An objective of the present invention is to provide a paving assembly, that is improved relative to the prior art and wherein at least one of the above stated problems is obviated.

Said objective is achieved with the paving assembly according to the present invention, comprising:

- a transporter with a material feed configured to arrange a layer of paving material at a first distance from said transporter;
- a first material hopper in connection with the material feed and configured to receive a paving material;
- a superstructure that is selectively arrangeable on or over the transporter, wherein said superstructure comprises:
  - a frame;
  - a further material feed extending beyond the transporter and configured to convey the paving material at a discharge at a second distance from said transporter; and
  - a second material hopper in connection with the further material feed and configured to receive the paving material,
- wherein the superstructure comprises both the first material hopper and the second material hopper
- wherein both the first material hopper and the second material hopper are arranged substantially central relative to a width of the transporter and readily and continuously accessible during use to allow them to be filled with paving material by a feeder for a continuous paving operation; and
- the further material feed is arranged substantially central relative to the width of the transporter and extending over the transporter.

According to the invention, the superstructure comprises both the first material hopper and the second material hopper, which are each arranged substantially central relative to the width of the transporter and readily and continuously accessible during use to allow them to be filled with paving material by a feeder for a continuous paving operation. The continuous operation capability preventing unnecessary stops on the one hand, as well as the optimal weight distribution resulting from both the first material hopper and the second material hopper each being arranged substantially central relative to the width of the transporter on the other hand, result in an optimally balanced paving assembly and consequently an evenly compacted pavement surface.

The further material feed is also arranged substantially central relative to the width of the transporter and extends over the transporter. In this configuration, the material feed itself, and also the paving material transported by said material feed during use, are centrally arranged relative to the width direction of said transporter. Therefore, the weight is optimally distributed, resulting in a well balanced paving assembly and consequently an evenly compacted pavement surface.

The well balanced paving assembly provided by the present invention may be used to lay pavement up to a width of 15 meters, thereby being capable of laying up to five driving lanes at once with a single paving assembly and corresponding further paving machine for the top layer. In comparison, the paving assembly disclosed in DE 20 2005 004 049 U1 is—due to its unbalanced nature caused by the sideward offset between the paving assembly and the further paving machine—only suitable to lay a limited width of one driving lane. Consequently, laying five driving lanes would require five sets of a paving assembly and associated further paving machine. All these ten machines, i.e. the five paving assemblies and the five further paving machines, need to be supplied with paving material, also requiring regular filling stops. Such stops causing inconsistencies in the compactness of the pavement, and therefore in a reduced life time. Moreover, using sets of a paving assembly and associated further paving machine for each driving lane, causes a challenge to optimally align the adjacent driving lanes to prevent seams or ridges.

A substantially central placement of the first material hopper, the second material hopper and the further material feed that extends over the transporter also results in dimensions for the assembly of the transporter and the superstructure that may be transported on a low loader, without the need to remove the superstructure. Due to the placement of the further material feed sideward relative to the transporter in DE 20 2005 004 049 U1, the resulting width is too large for transport within official regulations, requiring the superstructure to be removed for each transport, which is rather cumbersome.

Both the first material hopper and the second material hopper are arranged readily and continuously accessible during use to allow them to be filled with paving material by a feeder for a continuous paving operation. A feeder may supply paving material to either one of the first material hopper and the second material of the paving assembly. The further material feed may continously transport paving material to the further paving machine. In this way the material hopper of the further paving machine may be supplied with the same amount of paving material as being withdrawn therefrom. In other words, the material hopper of the further paving machine may be of a relatively constant weight, resulting in a very evenly compacting of the pavement, especially of the relatively thin top layer thereof, when the further paving machine travels forward and lays the top layer.

By applying an assembly of a transporter and a superstructure that can be selectively arranged on or over the transporter, the invention provides an efficient solution for the time consuming and laborious process of converting a paving machine. Instead of this conversion putting a conventional paving machine out of use for two working days, a conversion may be executed in about four hours if a superstructure of an assembly according to the invention is used. This means, that a conversion may be done overnight, allowing the paving assembly to be used again for paving the next day. Or, if the paving is done at night time, the conversion may be done during the day. The transporter may be a base unit of a conventional paving machine, and by arranging a dedicated superstructure on said transporter, the paving assembly according to the invention is suitable to be used in a method of arranging two layers of paving material in one operation. In this operation, a paving assembly according to the invention and a conventional paving machine may be used in series. The paving assembly comprises both a material feed configured to arrange a layer of paving material at a first distance from said transporter and a further material feed extending over the transporter and configured to convey the paving material at a discharge at a second distance from said transporter. A conventional paving machine may drive behind the paving assembly with a material hopper thereof being positioned below the discharge of the further material feed, i.e. at the second distance from the transporter of the paving assembly.

According to a preferred embodiment of the paving assembly, the further material feed is extending parallel to a longitudinal direction of said transporter. A transport direction of the further material feed thus corresponds to a straight rearward/forward moving direction of said transporter. This results in the shortest possible length of said further material feed, and consequently the lowest obtainable weight for said material feed. Consequently, the superstructure, that is configured to support the further material feed, may itself be build lighter.

The invention further relates to a superstructure that is configured to be selectively arrangeable on or over a transporter of a paving assembly, said superstructure comprising:

- a frame;
- a further material feed extending beyond the transporter and configured to convey the paving material at a discharge at a second distance from said transporter; and
- a second material hopper in connection with the further material feed and configured to receive the paving material;
- wherein the superstructure comprises both the first material hopper and the second material hopper;
- wherein both the first material hopper and the second material hopper are arranged substantially central relative to the width of the transporter and readily and continuously accessible during use to allow them to be filled with paving material by a feeder for a continuous paving operation of the paving assembly; and
- wherein the further material feed is arranged substantially central relative to the width of the transporter and extending over the transporter.

The invention further relates to a method of providing a paving assembly, comprising the steps of:

- providing a transporter with a material feed configured to arrange a layer of paving material at a first distance from said transporter;
- providing a superstructure according to the invention:
- arranging said transporter under the superstructure;
- supporting the superstructure with the transporter; and
- connecting the superstructure to the transporter.

Preferred embodiments are the subject of the dependent claims.

The various aspects and features described and shown in the specification can be applied, individually, wherever possible. These individual aspects, and in particular the aspects and features described in the attached dependent claims, may be made subject of divisional patent applications.

In the following description preferred embodiments of the present invention are further elucidated with reference to the drawing, in which.

Figure 1:
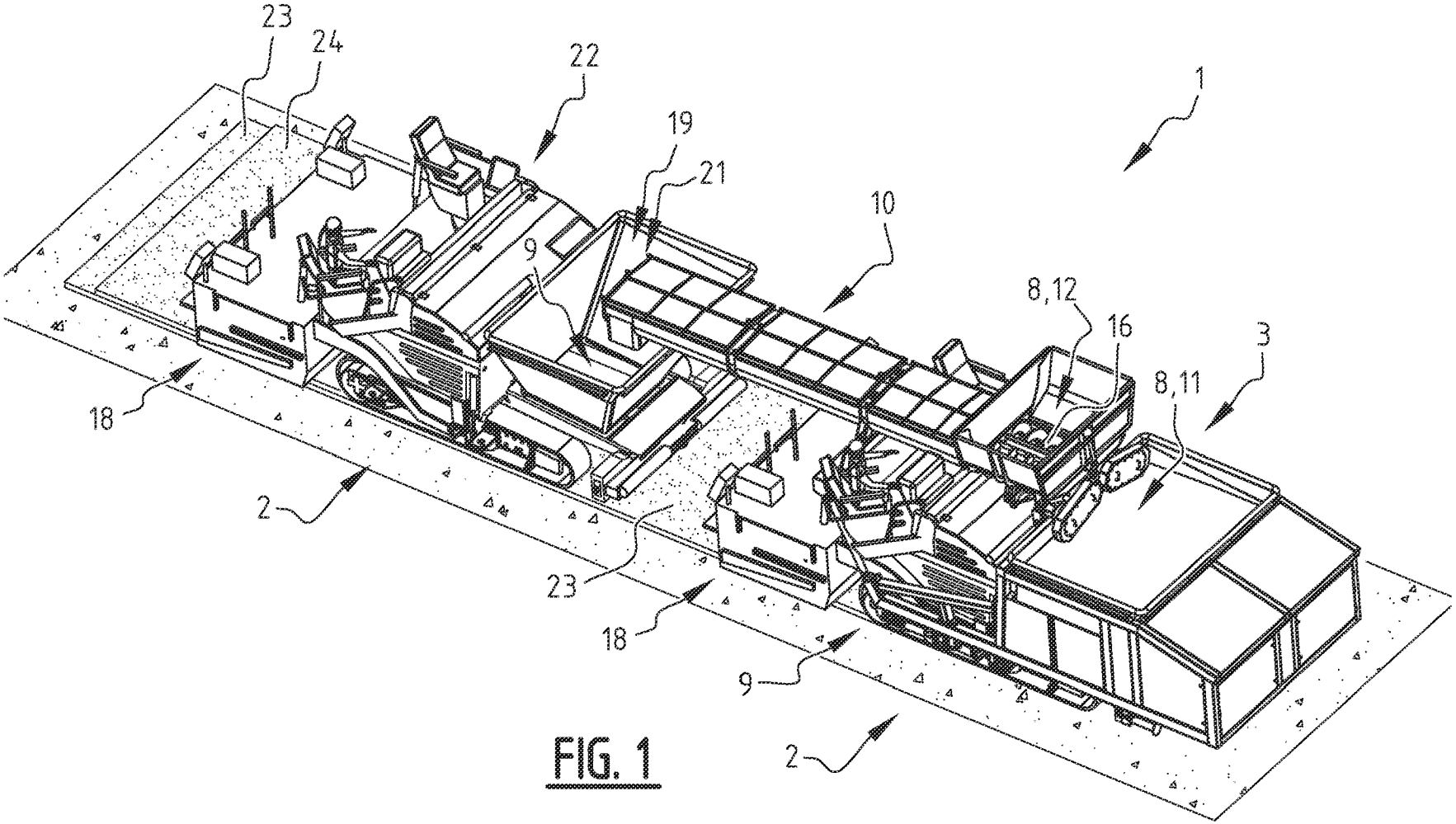
FIG. 1 is a perspective view of a paving assembly according to the invention in series with a conventional paving machine.
Figure 2:
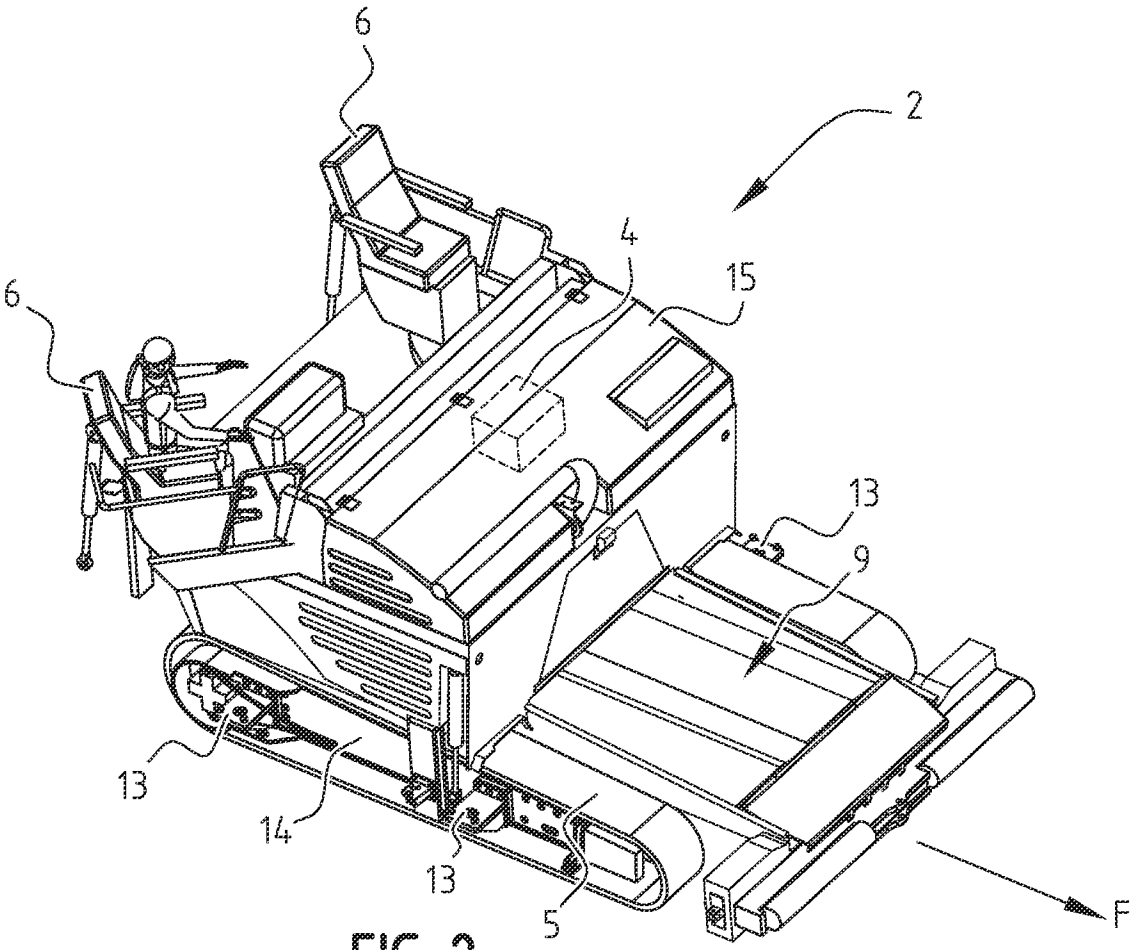
FIG. 2 is a perspective view of a transporter of the paving assembly of FIG. 1.
Figure 3:
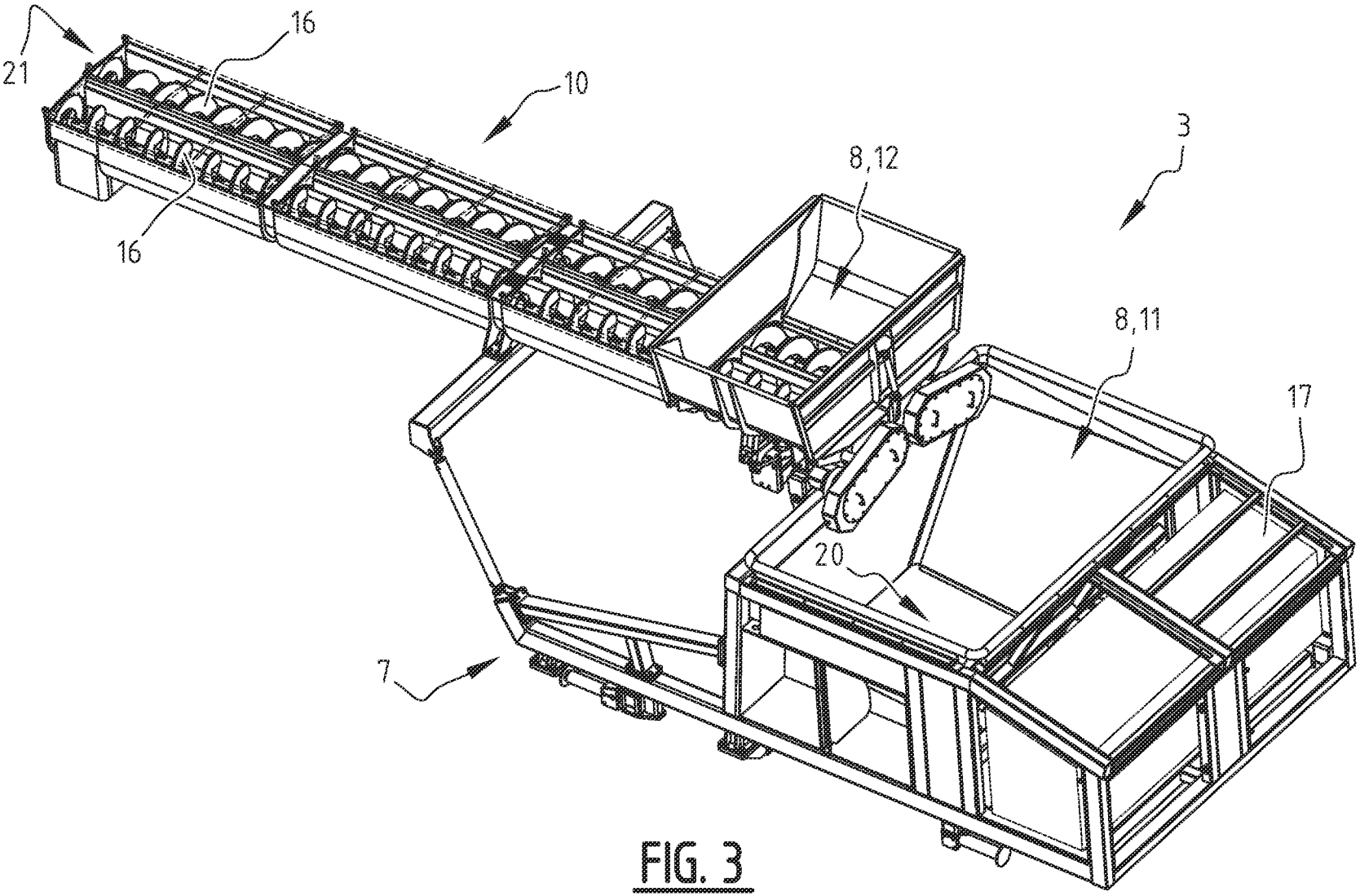
FIG. 3 is a perspective view of a superstructure of the paving assembly of FIG. 1.

The paving assembly 1 shown in FIG. 1 comprises a transporter 2 (FIG. 2) and a superstructure 3 (FIG. 3). The superstructure 3 is selectively arrangeable on or over the transporter 2 to allow for an efficient and fast conversion between a paving assembly 1 that is suitable for arranging a single layer of paving material (similar to paving machine 22 in the left of FIG. 1), and the paving assembly 1 shown in FIG. 1 that is capable of arranging a first layer 23 of paving material by itself while simultaneously supplying a further paving machine 22 with paving material. The paving machine 22 may arrange a further layer 24 of paving material on top of the first layer 23 of paving material. In this way, two layers 23, 24 of paving material may be arranged in a single operation, wherein the paving assembly 1 is applied in series with the paving machine 22. In a two-layer arrangement, the first layer 23 is a base layer and the second layer is a top layer.

The transporter 2 comprises a base frame 14 and a base drive 4 that is configured to drive wheels or tracks 5 of the transporter 2. A forward driving direction of transporter 2 is indicated with the arrow F. The transporter 2 may comprise one or more seats 6 for operators/drivers of the paving assembly 1.

The superstructure 3 comprises a frame 7 and at least one material hopper 8 that is configured to receive a paving material. The paving material inside material hopper 8 may be conveyed out of said material hopper 8 through opening 20 with a material feed 9 of said transporter 2. The superstructure 3 comprises a further material feed 10. In an assembled state, the material feed 9 of transporter 2 is configured to arrange a first layer 23 of paving material at a first distance from said transporter 2, similar to a conventional paving machine 22. The further material feed 10 extends over and past the transporter 2 and is configured to convey the paving material at a discharge 21 at a second distance from said transporter 2. A conventional paving machine 22 may drive behind the paving assembly 1 with a material hopper 19 thereof being positioned below the discharge 21 of the further material feed 10, i.e. at the second distance from the transporter 2 of the paving assembly 1 (FIG. 1).

The second distance is larger than the first distance, i.e. the first layer 23 is first arranged relatively close behind the transporter 2. When the transporter 2 drives the superstructure 3 in forward direction F, paving material is discharged via the further material feed 10 at the discharge 21 at a second distance behind the transporter 2. In this way, while driving the transporter 2 of the paving assembly 1 in forward direction F, first a first layer 23 is arranged, and a second layer 24 is successively arranged on top of this first layer 23 with a conventional paving machine 22.

In the shown preferred embodiment, the superstructure 3 comprises a first material hopper 8, 11 in connection with the material feed 9 of transporter 2, and a second material hopper 8, 12 in connection with the further material feed 10 of the superstructure 3.

The superstructure 3 is selectively arrangeable on one or more than one support 13 of the base frame 14. Due to the supports 13 being arranged directly on the base frame 14 of the transporter 2, the superstructure 3 will be supported in a reliable manner without putting a load on a body 15 of the transporter 2.

The further material feed 10 comprises at least one worm wheel 16 that is arranged in a transport direction of said transporter 2. Thus, the further material feed 10 and a rotation axis of the at least one worm wheel 16 thereof extend in a longitudinal direction. This longitudinal direction coincides with a forward/rearward transport direction of said transporter 2. Using one or more than one worm wheel 16, the paving material can be reliably transported via the further material feed 10. Moreover, a worm wheel 16 mixes the paving material during forward displacement of said paving material.

In the shown embodiment, the further material feed 10 comprises two worm wheels 16 that are arranged in a transport direction of said transporter 2. The worm wheels 16 may be configured to be driven in an opposite driving direction.

The superstructure 3 may comprise a power source 17, such as an engine, that is configured to provide power for driving at least the further material feed 10. In this way, the superstructure 3 has a dedicated power source 17 for the further material feed 10, and consequently will not have to rely on the drive 4 or any other (not shown) power source of the transporter 2.

A screed 18, which is configured to heat and compress the freshly added layer 23, 24 of paving material, is arranged behind the transporter 2.

An optimum weight balance is obtained if the further material feed 10 extends towards a rear side of the superstructure 3 and the power source 17 is arranged on a front side of the superstructure 3.

The invention is further related to a method of providing a paving assembly 1, comprising the steps of:

providing a transporter 2 with a material feed 9 configured to arrange a layer 23 of paving material at a first distance from said transporter 2;

providing a superstructure 3 as described above;

arranging said transporter 2 under the superstructure 3;

supporting the superstructure 3 with the transporter 2; and connecting the superstructure 3 to the transporter 2.

The step of supporting the superstructure 3 with the transporter 2 preferably comprises the step of supporting the superstructure 3 on one or more than one support 13 of a base frame 14 of said transporter 2.

The above described embodiment is intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims. The scope of the invention is defined solely by the following claims.

The invention claimed is:

1. A superstructure that is configured to be selectively arrangeable on or over a transporter of a paving assembly, wherein said superstructure comprises:

a frame;

a further material feed that is extendable beyond the transporter and configured to convey a paving material at a discharge at a second distance from said transporter, wherein said further material feed is arrangeable substantially central relative to a width of the transporter and extendable over the transporter; and a second material hopper in connection with the further material feed and configured to receive the paving material, wherein said second material hopper is arrangeable substantially central relative to a width of the transporter;

wherein the superstructure comprises the second material hopper and a first material hopper, wherein the first material hopper of the superstructure is:

configured to receive the paving material;

configured to be in connection with a material feed of the transporter that is configured to arrange a layer of paving material at a first distance from said transporter; and arrangeable substantially central relative to the width of the transporter; and wherein both the first material hopper and the second material hopper of the superstructure are readily and continuously accessible during use to allow them to be filled with paving material by a feeder for a continuous paving operation of the paving assembly.

2. A paving assembly, comprising:

a transporter with a material feed configured to arrange a layer of paving material at a first distance from said transporter;

a first material hopper in connection with the material feed and configured to receive a paving material; and a superstructure according to claim 1.

3. The paving assembly of claim 2, wherein the further material feed extends parallel to a longitudinal direction of said transporter.

4. The paving assembly of claim 2, wherein the superstructure comprises a power source configured to provide power for driving at least the further material feed.

5. The paving assembly of claim 4, wherein the further material feed extends towards a rear side of the superstructure and the power source is arranged on a front side of the superstructure.

6. The paving assembly of claim 2, wherein the transporter comprises:

a base frame; and a base drive configured to drive wheels or tracks of the transporter.

7. The paving assembly of claim 6, wherein the superstructure is selectively arrangeable on at least one support of the base frame.

8. The paving assembly of claim 2, wherein the further material feed comprises at least one worm wheel that is arranged in a transport direction of said transporter.

9. The paving assembly of claim 2, wherein the further material feed comprises two worm wheels that are arranged in a transport direction of said transporter.

10. The paving assembly of claim 9, wherein the worm wheels are configured to be driven in an opposite driving direction.

11. A method of providing a paving assembly, comprising the steps of:

providing a transporter with a material feed configured to arrange a layer of paving material at a first distance from said transporter;

providing a superstructure according to claim 1;

arranging said transporter under the superstructure;

supporting the superstructure with the transporter; and connecting the superstructure to the transporter.

12. The method of claim 11, wherein the step of supporting the superstructure with the transporter comprises supporting the superstructure on one or more than one support of a base frame of said transporter.

13. The method according to claim 11, wherein the paving assembly comprises:

a transporter with a material feed configured to arrange a layer of paving material at a first distance from said transporter;

a first material hopper in connection with the material feed and configured to receive a paving material; and a superstructure comprising:

a frame;

a further material feed that is extendable beyond the transporter and configured to convey a paving material at a discharge at a second distance from said transporter, wherein said further material feed is arrangeable substantially central relative to a width of the transporter and extendable over the transporter; and a second material hopper in connection with the further material feed and configured to receive the paving material, wherein said second material hopper is arrangeable substantially central relative to a width of the transporter;

wherein the superstructure comprises the second material hopper and a first material hopper, wherein the first material hopper of the superstructure is:

configured to receive the paving material;

configured to be in connection with a material feed of the transporter that is configured to arrange a layer of paving material at a first distance from said transporter; and arrangeable substantially central relative to the width of the transporter; and wherein both the first material hopper and the second material hopper of the superstructure are readily and continuously accessible during use to allow them to be filled with paving material by a feeder for a continuous paving operation of the paving assembly.

* * * * *